US012607197B2

(12) United States Patent
Lai et al.

(10) Patent No.: US 12,607,197 B2
(45) Date of Patent: Apr. 21, 2026

(54) FAN MECHANISM

(71) Applicant: Delta Electronics, Inc., Taoyuan City (TW)

(72) Inventors: Wei-Ming Lai, Taoyuan City (TW); Ting-Ying Chuang, Taoyuan City (TW); Chien-Yu Chen, Taoyuan City (TW); Chi-Chang Teng, Taoyuan City (TW)

(73) Assignee: DELTA ELECTRONICS, INC., Taoyuan City (TW)

( * ) Notice: Subject to any disclaimer, the term of this patent is extended or adjusted under 35 U.S.C. 154(b) by 0 days.

(21) Appl. No.: 19/195,854

(22) Filed: May 1, 2025

(65) Prior Publication Data

US 2026/0055775 A1 Feb. 26, 2026

(30) Foreign Application Priority Data

Aug. 26, 2024 (CN) ..... 202422075566.2

(51) Int. Cl.
*F04D 29/28* (2006.01)
*F04D 29/62* (2006.01)

(52) U.S. Cl.
CPC ..... *F04D 29/281* (2013.01); *F04D 29/62* (2013.01)

(58) Field of Classification Search
CPC ..... F04D 29/281; F04D 29/30; F05D 2230/54
See application file for complete search history.

(56) References Cited

U.S. PATENT DOCUMENTS 3,144,204 A * 8/1964 Bohanon ..... F04D 29/282 416/220 A
3,147,541 A * 9/1964 Hathaway ..... B21D 53/267 29/889.4
3,909,919 A * 10/1975 Miyabayashi ..... F16B 17/008 29/521
6,132,826 A * 10/2000 Kawasaki ..... B29C 66/54 264/513
6,156,090 A * 12/2000 Ishikawa ..... F04D 29/30 416/243
9,951,782 B2 * 4/2018 Kurihara ..... F04D 17/10
2003/0196307 A1 * 10/2003 Chen ..... B23K 1/0008 29/421.1
2015/0377247 A1 * 12/2015 Laurila ..... F04D 29/281 29/889.4
2016/0186770 A1 * 6/2016 Son ..... B21D 11/20 416/223 R
2017/0241431 A1 * 8/2017 Wolf ..... F04D 29/281

FOREIGN PATENT DOCUMENTS

JP 2011032991 A * 2/2011

* cited by examiner

*Primary Examiner* — Eldon T Brockman
(74) *Attorney, Agent, or Firm* — Muncy, Geissler, Olds & Lowe, P.C.

(57) ABSTRACT

A fan mechanism is provided. The fan mechanism includes an upper base, a lower base, and a plurality of blades. The blades are disposed between the upper base and the lower base, and each of the blades includes a first surface and a second surface. The second surface has a first contact portion and a second contact portion on opposite sides. The first contact portion is in contact with the corresponding second contact portion. The first surface includes a hole penetrating the second surface. The second surface is connected to a protruding pillar, and the protruding pillar is embedded into the hole.

20 Claims, 6 Drawing Sheets

FAN MECHANISM

CROSS REFERENCE TO RELATED APPLICATIONS

The present application claims priority of China Patent Application No. 202422075566.2, filed Aug. 26, 2024, which is incorporated by reference herein in its entirety.

BACKGROUND OF THE INVENTION

Field of the Invention

The application relates in general to a fan mechanism, and in particular, to a fan mechanism that can be facilitated to manufacture.

Description of the Related Art

When an electronic device or server is in use, it may easily become unstable if the temperature is not suitably controlled, and the reliability of the product can be influenced accordingly. Thus, current electronic device usually uses a fan as a heat dissipating device.

However, the blades of current centrifugal fans are usually generated by aluminum extrusion, and the blades need to be placed in an inclined manner. Therefore, they need to be positioned using fixtures. The cost and the time for manufacturing the fan are high. Therefore, how to address the aforementioned problem has become an important issue.

BRIEF SUMMARY OF INVENTION

To address the deficiencies of conventional products, an embodiment of the invention provides a fan mechanism. The fan mechanism includes an upper base, a lower base, and a plurality of blades. The blades are disposed between the upper base and the lower base, and each of the blades includes a first surface and a second surface. The second surface has a first contact portion and a second contact portion on opposite sides. The first contact portion is in contact with the corresponding second contact portion. The first surface includes a hole penetrating the second surface. The second surface is connected to a protruding pillar, and the protruding pillar is embedded into the hole.

In some embodiments, the protruding pillar is substantially perpendicular to the second contact portion.

In some embodiments, the protruding pillar is connected to the second contact portion, and a fold line is formed between the protruding pillar and the second contact portion, wherein each of the blades includes an upper side, a lower side, and a first side, the upper side faces the upper base, the lower side faces the lower base, the first side is connected to the upper side and the lower side, and the fold line is substantially perpendicular to the first side.

In some embodiments, the first contact portion is affixed to the second contact portion by discontinuous spot welding, and a plurality of welding spots are formed between the first contact portion and the second contact portion.

In some embodiments, the welding spots are arranged at equal intervals.

In some embodiments, the second surface has a notch, and the notch is adjacent to the protruding pillar.

In some embodiments, at least one of the welding spots is adjacent to the protruding pillar.

In some embodiments, the distance between adjacent welding spots is greater than the distance between the first surface and the second surface. For example, the distance between adjacent welding spots can be within a range of 20 mm to 30 mm, and the distance between the first surface and the second surface can be within a range of 1 mm to 3 mm.

In some embodiments, each of the blades includes an upper side facing the upper base, and each of the blades includes an upper positioning protrusion protruding from the upper side and entering an upper positioning hole of the upper base.

In some embodiments, each of the blades includes a lower side facing the lower base, and each of the blades includes a lower positioning protrusion protruding from the lower side and entering a lower positioning hole of the lower base.

In some embodiments, each of the blades includes an upper side, a lower side, a first side, and a second side, the upper side faces the upper base, the lower side faces the lower base, the first side is connected to the upper side and the lower side, the second side is connected to the upper side and the lower side, and the first side and the second side face the same direction.

In some embodiments, the lower base includes a body portion and a balance portion, the body portion substantially includes a disk structure, and the balance portion is connected to the periphery of the body portion and extends toward the upper base.

In some embodiments, the blades are inclined relative the body portion of the lower base.

In some embodiments, the upper base includes a body portion and a balance portion, the body portion substantially includes a tapered structure, and the balance portion is connected to the periphery of the body portion and extends toward the lower base.

In some embodiments, the upper base includes a central opening, the portion of the body portion that is adjacent to the central opening is far from the lower base, and the portion of the body portion that is away from the central opening is close to the lower base.

In some embodiments, a hollow space is formed and surrounded by the second surface.

In some embodiments, each of the blades has a folded structure, the first surface is the outer surface of each blade, and the second surface is the inner surface of each blade.

In some embodiments, each of the blades includes metal and is integrally formed as one piece.

In some embodiments, each of the blades includes an upper side facing the upper base and a lower side facing the lower base, the upper side is affixed to the upper base by welding, and the lower side is affixed to the lower base by welding.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The making and using of the embodiments of the fan mechanism are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Figure 1:
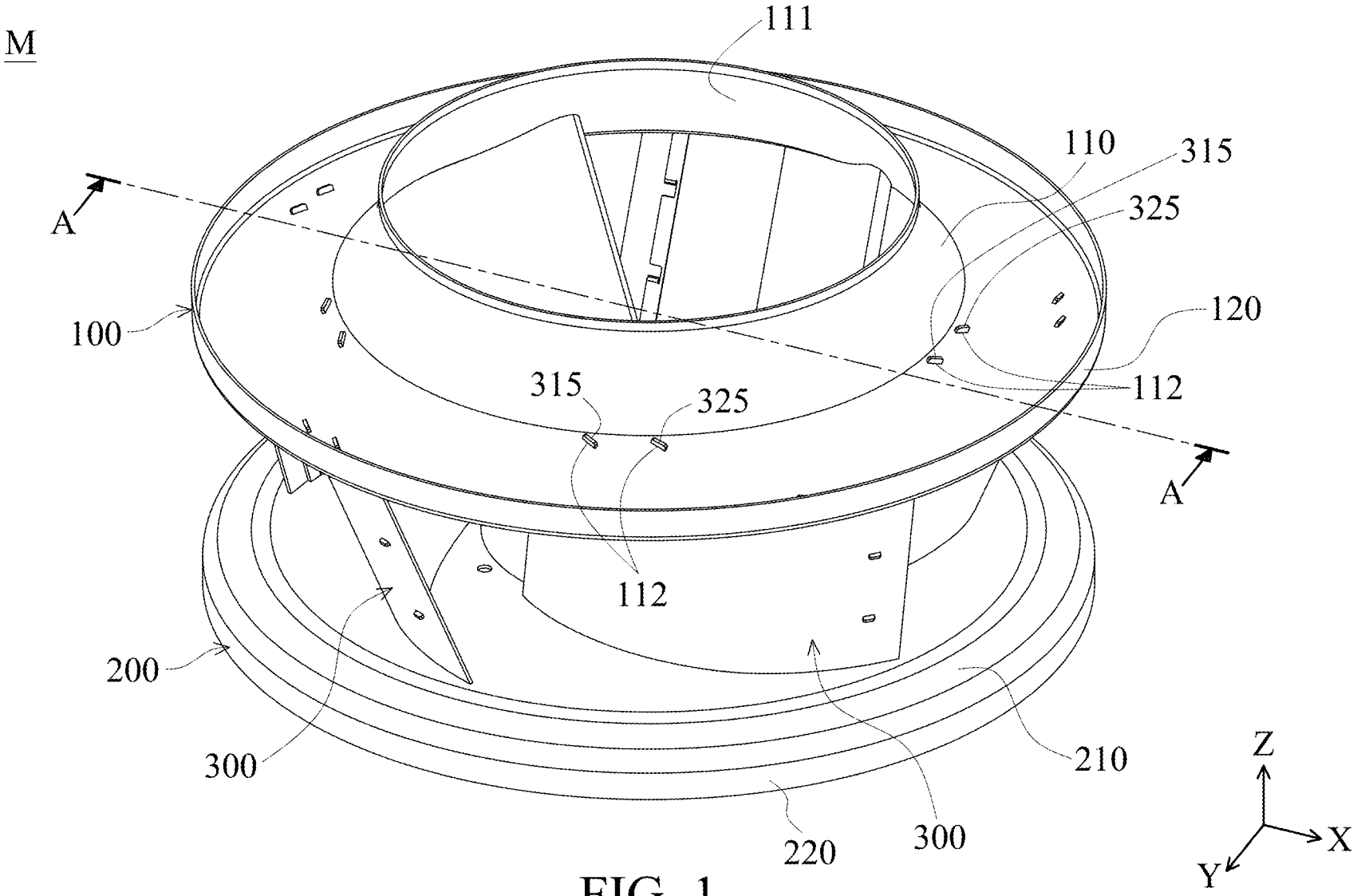
FIG. 1 is a schematic diagram of a fan mechanism according to an embodiment of the invention.

FIG. 1 is a schematic diagram of a fan mechanism M according to an embodiment of the invention. For example, the fan mechanism M can be connected to an external motor, and the motor can drive to fan mechanism M to rotate, so as to drive the gas to flow in and out the fan mechanism M. In this embodiment, the fan mechanism M is a centrifugal fan, it primarily includes an upper base 100, a lower base 200, and a plurality of blades 300.

Figure 2:
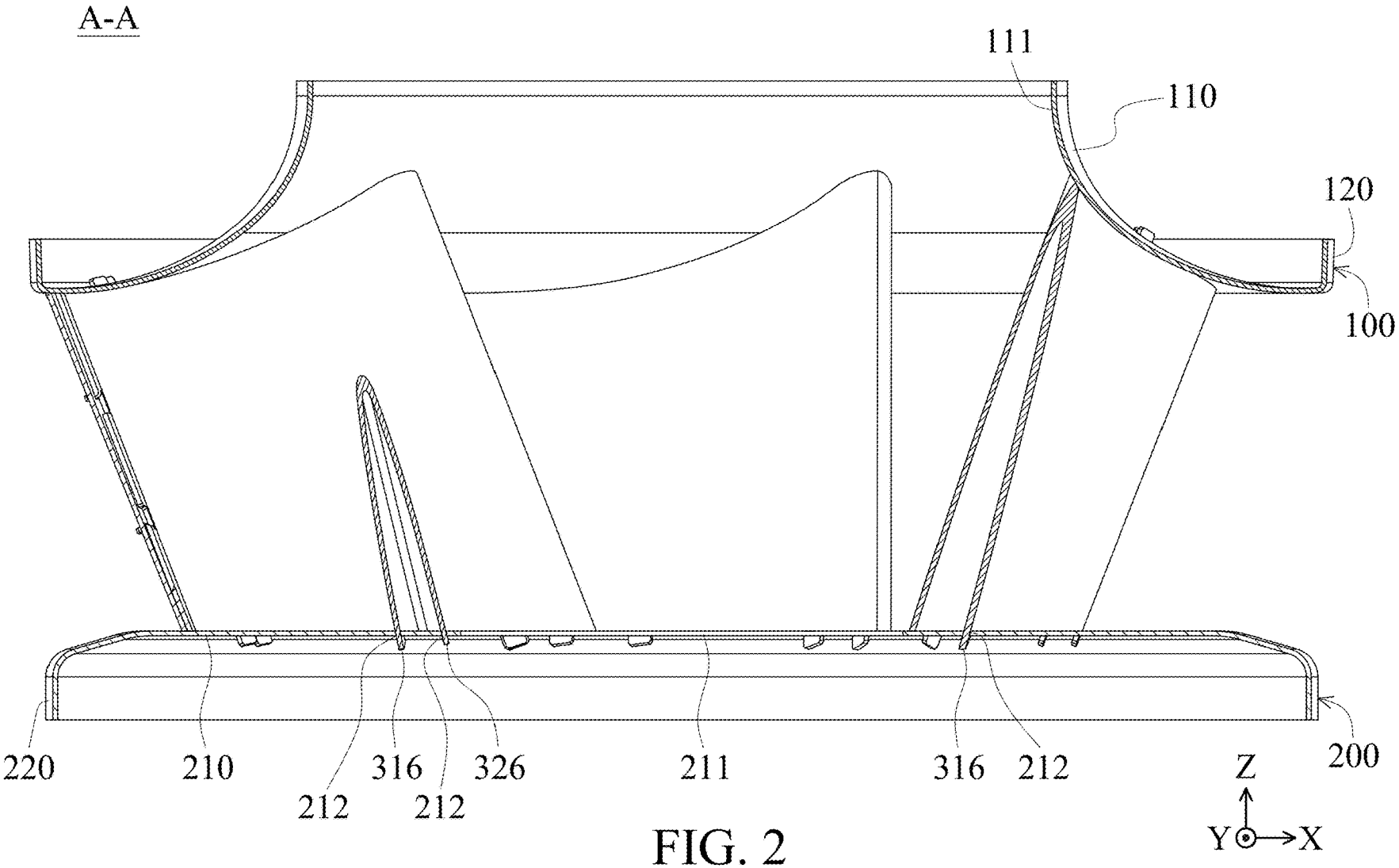
FIG. 2 is a cross-sectional view taken along the line A-A in FIG. 1.

FIG. 2 is a cross-sectional view taken along the line A-A in FIG. 1. As shown in FIG. 1 and FIG. 2, the upper base 100 includes a body portion 110 and a balance portion 120. The body portion 110 has a central opening 111, and its whole shape substantially includes a tapered structure. Therefore, the portion of the body portion 110 that is adjacent to the central opening 111 is far from the lower base 200, and the portion of the body portion 110 that is away from the central opening 111 is close to the lower base 200. The balance portion 120 has an annular structure, and it is connected to the periphery of the body portion 110 and extends toward the lower base 200 (in the figures, it extends along the Z-axis). The balance portion 120 is configured to connect one or more counterweights (not shown). The counterweights can be clamped on the balance portion 120, so that the user can easily adjust the balance of the fan mechanism M.

The lower base 200 includes a body portion 210 and a balance portion 220. The body portion 210 has a central opening 211, and substantially includes a disk structure. The balance portion 220 is connected to the periphery of the body portion 210 and extends toward the upper base 100 (in the figures, it extends along the −Z-axis). Similarly, the balance portion 220 is configured to connect one or more counterweights (not shown). The counterweights can be clamped on the balance portion 220, so that the user can easily adjust the balance of the fan mechanism M.

Figure 3A:
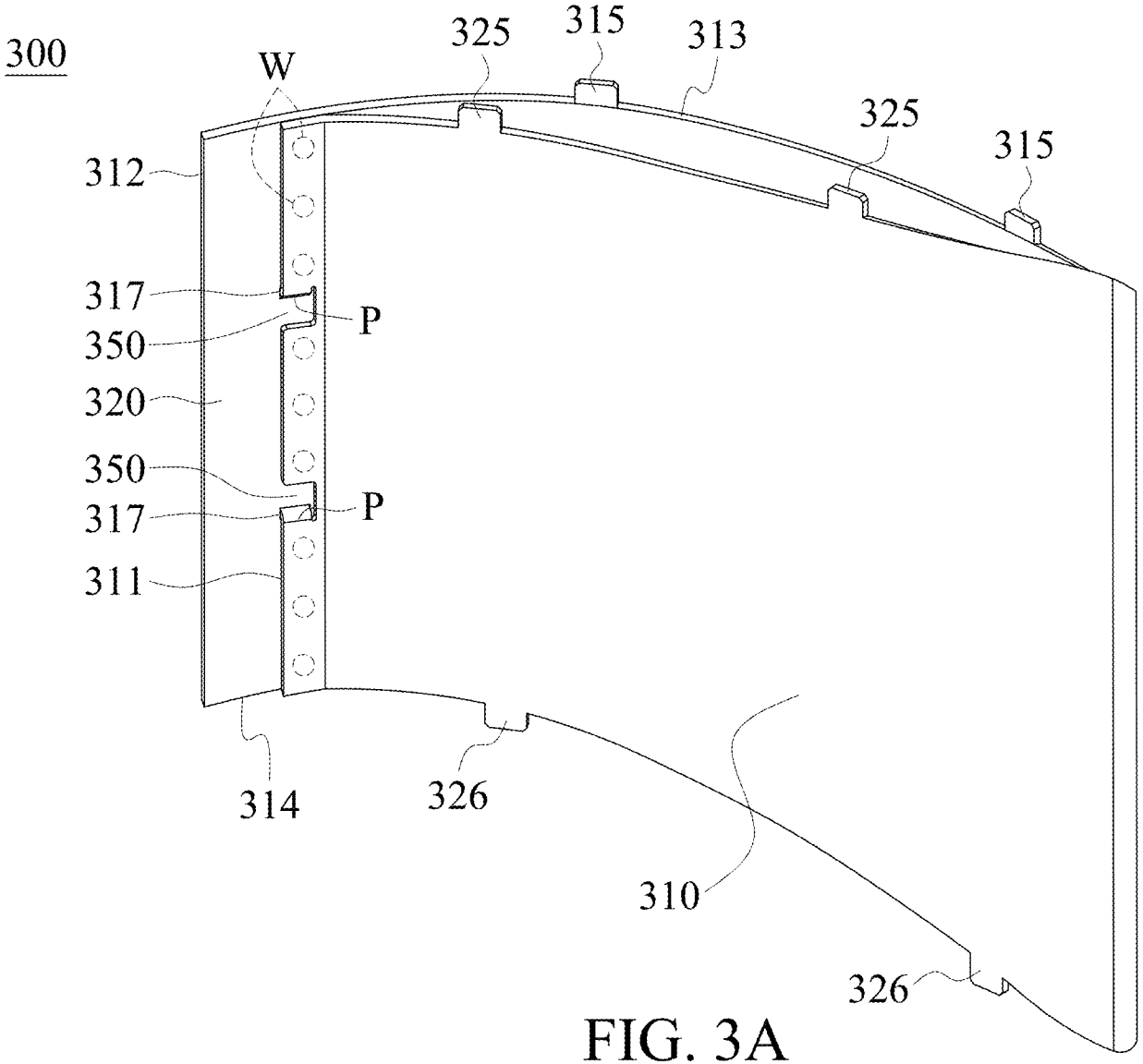
FIG. 3A is a schematic diagram of a blade according to an embodiment of the invention.
Figure 3B:
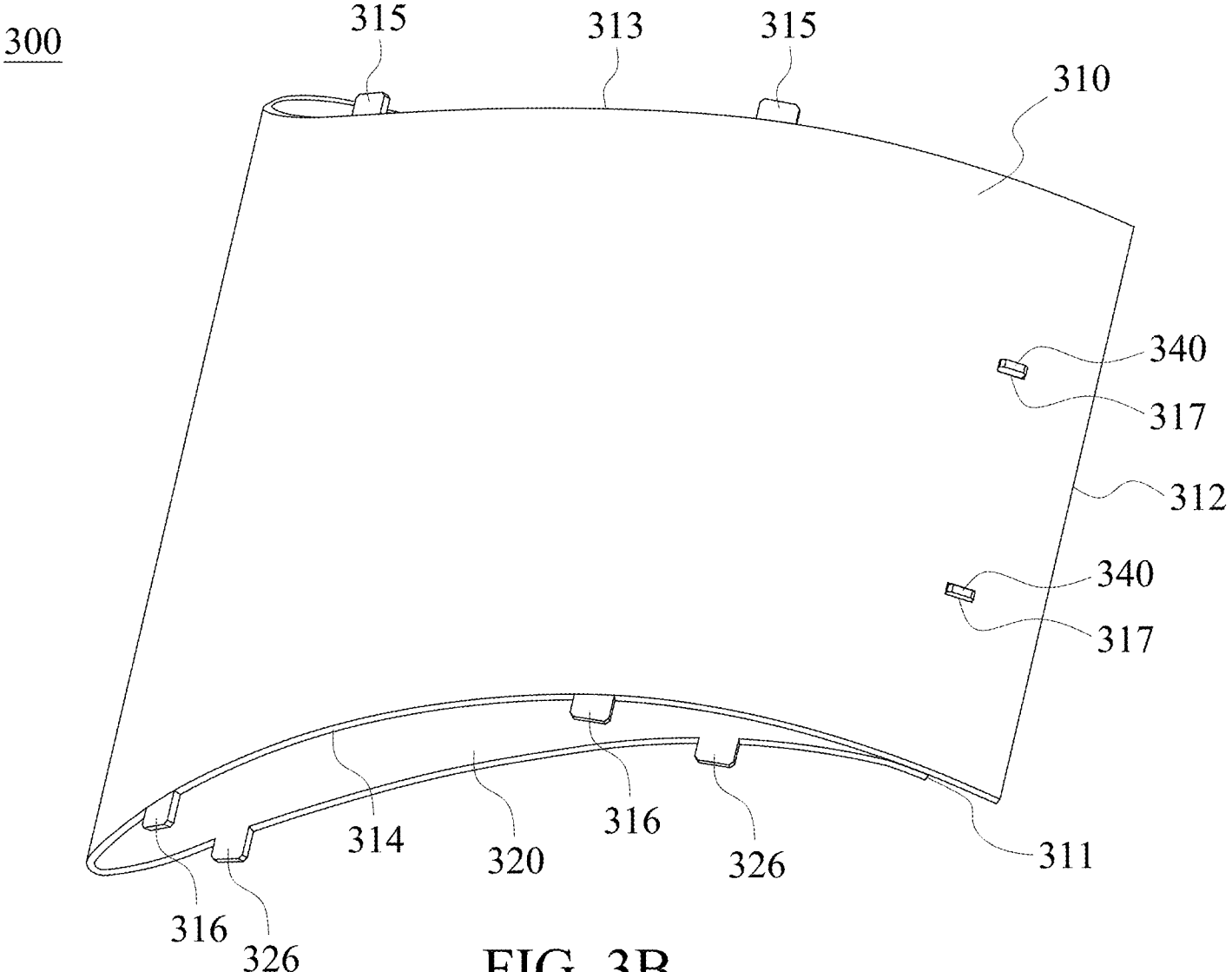
FIG. 3B is a schematic diagram of the blade in another view according to an embodiment of the invention.
Figure 3C:
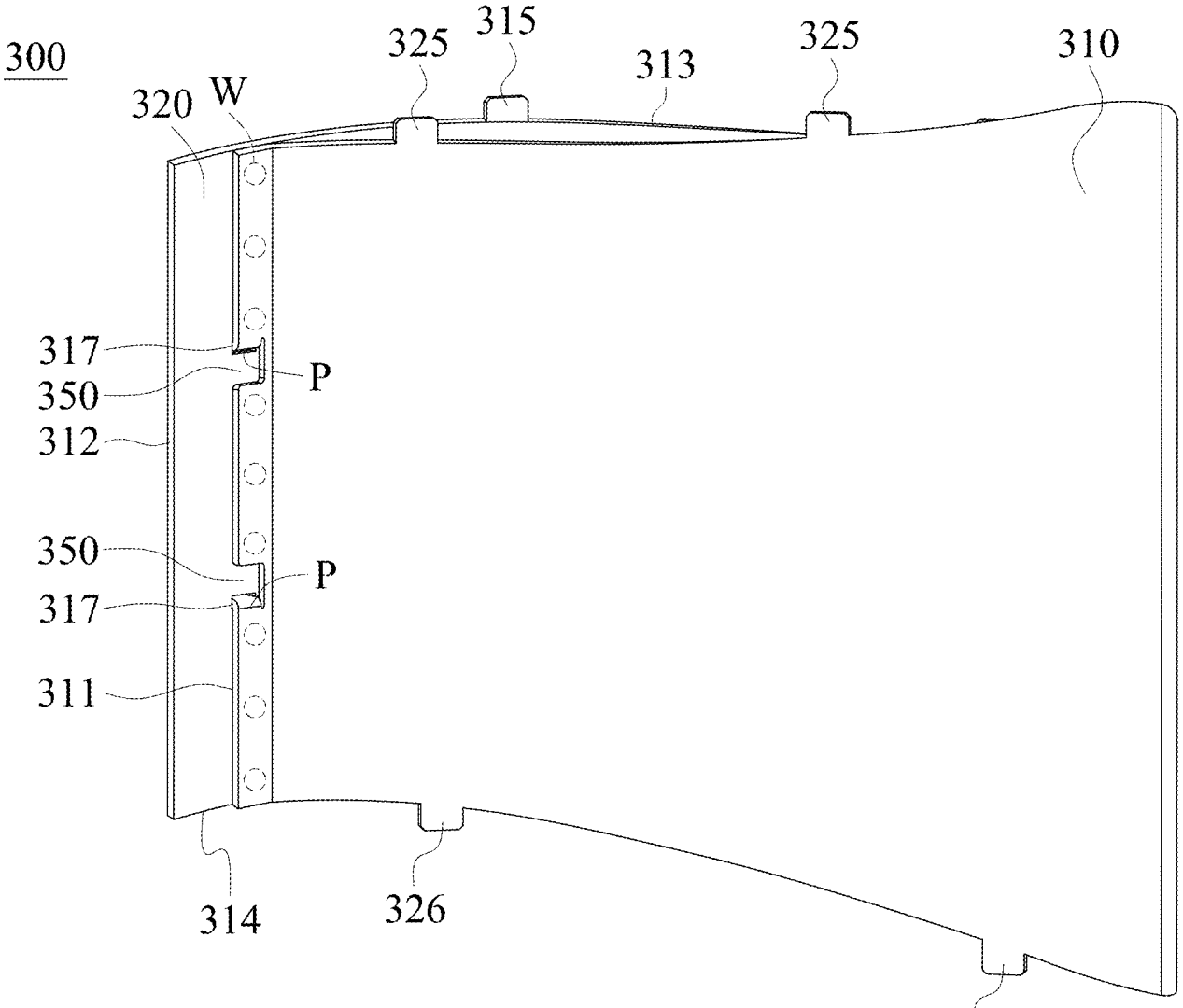
FIG. 3C is a front view of the blade according to an embodiment of the invention.
Figure 3D:
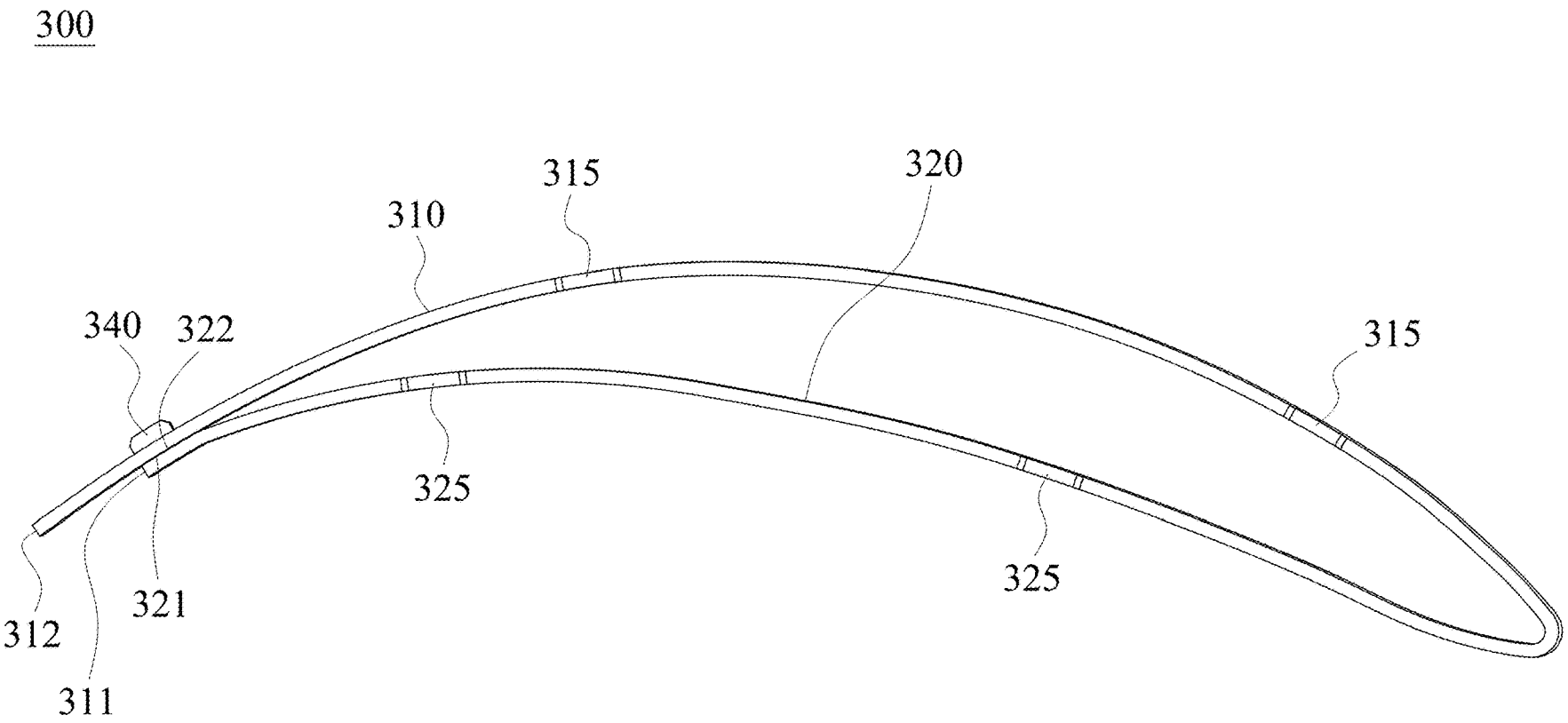
FIG. 3D is a top view of the blade according to an embodiment of the invention.

FIG. 3A is a schematic diagram of one of the blades 300 of the fan mechanism M, FIG. 3B is a schematic diagram of the aforementioned blade 300 in another view, and FIG. 3C and FIG. 3D are respectively a front view and a top view of the aforementioned blade 300. As shown in FIG. 3A to FIG. 3D, each blade 300 includes a first surface 310, a second surface 320, an upper side 313, a lower side 314, a first side 312, and a second side 311.

The blade 300 has a folded structure, so that the first surface 310 is the outer surface of the blade 300, and the second surface 320 is the inner surface of the blade 300. The upper side 313 faces the upper base 100, the lower side 314 faces the lower base 200, and the first side 312 and the second side 311 are connected to the upper side 313 and the lower side 314. Since the blade 300 has the folded structure, the first side 312 and the second side 311 face the same direction.

In this embodiment, one or more upper positioning protrusions 315 and 325 are disposed on the upper side 313, and one or more lower positioning protrusions 316 and 326 are disposed on the lower side 314. The upper positioning protrusions 315 and 325 protrude from the upper side 313, and the lower positioning protrusions 316 and 326 protrude from the lower side 314.

At least one hole 317 is formed on the first surface 310, and the hole 317 penetrates the second surface 320.

The second surface 320 has a first contact portion 321 and a second contact portion 322. The first contact portion 321 is adjacent to the first side 312, and the second contact portion 322 is adjacent to the second side 311. Therefore, the first contact portion 321 and the second contact portion 322 are situated on opposite sides of the blade 300.

During the manufacture of the blade 300, the first contact portion 321 can be affixed to the second contact portion 322 by discontinuous spot welding, so as to let the first contact portion 321 being in contact with the second contact portion 322. For example, as shown in FIG. 3C, after the first contact portion 321 is affixed to the second contact portion 322 by discontinuous spot welding, a plurality of welding spots W can be formed between the first contact portion 321 and the second contact portion 322. In this embodiment, the welding spots W are arranged at equal intervals, and the distance between adjacent welding spots W is greater than the thickness of the blade 300 (i.e. the distance between the first surface 310 and the second surface 320). For example, the thickness of the blade 300 can be within a range of 1 mm to 3 mm (such as 2 mm), and the distance between adjacent welding spots W can be within a range of 20 mm to 30 mm (such as 25 mm).

At least one protruding pillar 340 and at least one notch 350. The protruding pillar 340 can be embedded into the hole 317 of the first surface 310, and the notch 350 is adjacent to the protruding pillar 340. In this embodiment, the protruding pillar 340 is substantially perpendicular to the second contact portion 322, and a fold line P can be formed between the protruding pillar 340 and the second contact portion 322. The fold line P is substantially perpendicular to the first side 312, so that the windage and the influence of the wind stream can be reduced.

At least one of the welding spot W is adjacent to the protruding pillar 340, so as to prevent the undesired bending of the blade 300.

Moreover, as shown in FIG. 3D, except the first contact portion 321 and the second contact portion 322, the remaining portions of the second surface 320 are not in contact, so that a hollow space can be formed. Therefore, the weight and the cost of the fan mechanism M can be reduced, and it is facilitated for the motor to drive the fan mechanism M.

In this embodiment, the blade 300 can include metal and can be integrally formed as one piece, but it is not limited thereto.

Referring to FIG. 1 to FIG. 3D, when the fan mechanism M is assembled, the blade 300 can be disposed between the upper base 100 and the lower base 200, and the blade 300 is inclined relative to the body portion 210 of the lower base 200. That is, an acute angle can be formed between the blade 300 and the body portion 210.

The body portion 110 of the upper base 100 has a plurality of upper positioning holes 112 corresponding to the upper protrusions 315 and 325 of the blade 300. In particular, when the blade 300 is engaged with the upper base 100, the upper side 313 of the blade 300 is in contact with the body portion 110 of the upper base 100, and the upper positioning protrusions 315 and 325 enter the upper positioning holes 112 in an one-on-one manner, so as to position the blade 300 at a required position relative to the upper base 100. After that, the user can weld along the upper side 313 to affix the blade 300 to the upper base 100.

The body portion 210 of the lower base 200 has a plurality of lower positioning holes 212 corresponding to the lower protrusions 316 and 326 of the blade 300. In particular, when the blade 300 is engaged with the lower base 200, the lower side 314 of the blade 300 is in contact with the body portion 210 of the lower base 200, and the lower positioning protrusions 313 and 323 enter the lower positioning holes 212 in an one-on-one manner, so as to position the blade 300 at a required position relative to the lower base 200. After that, the user can weld along the lower side 314 to affix the blade 300 to the lower base 200.

In summary, an embodiment of the invention provides a fan mechanism, including an upper base, a lower base, and a plurality of blades. The blades are disposed between the upper base and the lower base, and each of the blades includes a first surface and a second surface. The second surface has a first contact portion and a second contact portion on opposite sides. The first contact portion is in contact with the corresponding second contact portion. The first surface includes a hole penetrating the second surface. The second surface is connected to a protruding pillar, and the protruding pillar is embedded into the hole.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar

What is claimed is:

1. A fan mechanism, comprising:

an upper base;

a lower base; and a plurality of blades, disposed between the upper base and the lower base, wherein each of the blades comprises:

a first surface; and a second surface, having a first contact portion and a second contact portion, wherein the first contact portion and the second contact portion face each other, wherein the first contact portion is in contact with the corresponding second contact portion, wherein the fan mechanism further comprises a hole, the hole is formed on the first surface and extends to the second surface, the second surface is connected to a protruding pillar, and the protruding pillar is embedded in the hole, wherein each of the blades comprises a first side surface and a second side surface, the first side surface is connected to the first surface and the second surface, the second side surface is connected to the first surface and the second surface and neither the first side surface nor the second side surface is enclosed by the second surface.

2. The fan mechanism as claimed in claim 1, wherein the protruding pillar is substantially perpendicular to the second contact portion.

3. The fan mechanism as claimed in claim 1, wherein the protruding pillar is connected to the second contact portion, and a fold line is formed between the protruding pillar and the second contact portion, wherein each of the blades comprises an upper side, a lower side, and a first side, the upper side faces the upper base, the lower side faces the lower base, the first side is connected to the upper side and the lower side, and the fold line is substantially perpendicular to the first side.

4. The fan mechanism as claimed in claim 1, wherein the first contact portion is affixed to the second contact portion by discontinuous spot welding, and a plurality of welding spots are formed between the first contact portion and the second contact portion.

5. The fan mechanism as claimed in claim 4, wherein the welding spots are arranged at equal intervals.

6. The fan mechanism as claimed in claim 4, wherein the second surface has a notch, and the notch is adjacent to the protruding pillar.

7. The fan mechanism as claimed in claim 4, wherein at least one of the welding spots is adjacent to the protruding pillar.

8. The fan mechanism as claimed in claim 4, wherein a distance between the adjacent welding spots is greater than a distance between the first surface and the second surface.

9. The fan mechanism as claimed in claim 8, wherein the distance between the adjacent welding spots is within a range of 20 mm to 30 mm, and the distance between the first surface and the second surface is within a range of 1 mm to 3 mm.

10. The fan mechanism as claimed in claim 1, wherein each of the blades comprises an upper side facing the upper base, and each of the blades comprises an upper positioning protrusion protruding from the upper side and entering an upper positioning hole of the upper base.

11. The fan mechanism as claimed in claim 1, wherein each of the blades comprises a lower side facing the lower base, and each of the blades comprises a lower positioning protrusion protruding from the lower side and entering a lower positioning hole of the lower base.

12. The fan mechanism as claimed in claim 1, wherein each of the blades comprises an upper side, a lower side, a first side, and a second side, the upper side faces the upper base, the lower side faces the lower base, the first side is connected to the upper side and the lower side, the second side is connected to the upper side and the lower side, and the first side and the second side face a same direction.

13. The fan mechanism as claimed in claim 1, wherein the lower base comprises a body portion and a balance portion, the body portion substantially includes a disk structure, and the balance portion is connected to a periphery of the body portion and extends toward the upper base.

14. The fan mechanism as claimed in claim 13, wherein the blades are inclined relative the body portion of the lower base.

15. The fan mechanism as claimed in claim 1, wherein the upper base comprises a body portion and a balance portion, the body portion substantially includes a tapered structure, and the balance portion is connected to a periphery of the body portion and extends toward the lower base.

16. The fan mechanism as claimed in claim 15, wherein the upper base comprises a central opening, a portion of the body portion that is adjacent to the central opening is far from the lower base, and a portion of the body portion that is away from the central opening is close to the lower base.

17. The fan mechanism as claimed in claim 1, wherein a hollow space is formed and surrounded by the second surface.

18. The fan mechanism as claimed in claim 1, wherein each of the blades has a folded structure, the first surface is an outer surface of each blade, and the second surface is an inner surface of each blade.

19. The fan mechanism as claimed in claim 1, wherein each of the blades includes metal and is integrally formed as one piece.

20. The fan mechanism as claimed in claim 1, wherein each of the blades comprises an upper side facing the upper base and a lower side facing the lower base, the upper side is affixed to the upper base by welding, and the lower side is affixed to the lower base by welding.

* * * * *